United States Patent [19]

Elliott et al.

[11] Patent Number: 4,503,091

[45] Date of Patent: Mar. 5, 1985

[54] SUBSTRATE ALIGNMENT AND LOADING METHOD FOR A POWDER REINFORCING MACHINE

[75] Inventors: Richard M. Elliott; Larry L. Holland, both of Beverly; Andrew J. Gilbride, Swampscott; Thomas J. Gilligan, III, Danvers; Lawrence P. Ciccia, Medford; John F. Martin, Essex, all of Mass.

[73] Assignee: USM Corporation, Farmington, Conn.

[21] Appl. No.: 558,057

[22] Filed: Dec. 5, 1983

[51] Int. Cl.[3] ..... B05C 13/00; B05C 13/02

[52] U.S. Cl. ..... 427/180; 427/300; 118/500; 118/503; 12/51; 12/52.5; 269/57; 414/763

[58] Field of Search ..... 118/500, 503; 12/51, 12/52.5, 33.6, 36, 37; 269/57, 238, 304, 305, 54, 37, 40, 160, 218, 229, 237, 317; 414/761, 762, 763, 783; 112/13, 62, 121.15; 227/154, 155; 427/300, 195, 180

[56] References Cited

U.S. PATENT DOCUMENTS

| | | | |
|---|---|---|---|
| 2,973,197 | 2/1961 | Algatt et al. | 269/238 |
| 3,107,376 | 10/1963 | Reid et al. | 12/33.6 |
| 3,909,889 | 10/1975 | Emerson | 269/238 |

*Primary Examiner*—Shrive P. Beck

*Attorney, Agent, or Firm*—Donald N. Halgren

[57] ABSTRACT

The method of aligning and loading a substrate onto a powder reinforcement machine wherein a guide pin arrangement is adjusted with respect to settings on a portion of the machine frame and then adjusted distancewise from the machine frame, the guide pins themselves then adjusted with respect to the guide pin support, to facilitate alignment of substrates on the machine, the settings being repeatable for differently contoured substrates if desirable. The guide pin support being shiftable for removal from the path of a substrate transport cube, permitting rapid alignment of successive substrates of a particular configuration.

7 Claims, 4 Drawing Figures

IV
IV
308
300
302
304
310
312
150
306
260
320
322
330
324
328
332
340
326
334

SUBSTRATE ALIGNMENT AND LOADING METHOD FOR A POWDER REINFORCING MACHINE

BACKGROUND OF THE INVENTION (1) Field of the Invention

This invention relates to deposition machinery useful for applying reinforcing/stiffening powder to a substrate, and more particularly to the method of aligning and loading a substrate such as a shoe upper onto a shoe upper reinforcing machine.

(2) Summary of the Prior Art

The shoe and apparel industry have for many years been applying stiffening and reinforcing means to their shoe uppers, blue jeans, pajamas, sports clothing, and visors of caps and the like.

U.S. patent application Ser. No. 451,919 to Simmonds et al. and assigned to the present assignee, shows a machine for applying powdered material to a substrate, wherein a powder deposition station having a stencil assembly applies powder onto an annular receiving belt, the powder being applied in a three-dimensional configuration because of peripheral spacer means arranged on the cut-out between the stencil and the receiving belt. The annular receiving belt surface is empowered to rotate to an arcurate heating station where the powder is fused by heating elements arranged thereabove and therebelow. The fused powder is then moved to a join and cool station where a substrate such as a shoe upper or a portion of a garment is first received in a fixed bracket on a transfer means at the join and cool station, and thereafter rotated and pressed against the fused powder by the transfer means causing it to press against a chill plate therebeneath. The substrate is then lifted by the transfer means from the receiving surface after it has been cooled, the transfer means with the fixed holding bracket holding the now reinforced substrate, rotating so as to remove the substrate from above the receiving surface to enable the transfer means to present the substrate at its initial location for unloading from the fixed holding bracket on the transfer means, to permit a subsequent substrate to be manipulated therewith.

It is an object of the present invention, to provide an improved method for loading a powder reinforcing machine.

BRIEF SUMMARY OF THE INVENTION

The present invention comprises method for loading a substrate such as a shoe upper on a powder deposition machine, wherein the method efficiently facilitates subsequent loading and unloading of the transfer means of the machine.

The transfer means comprises a rotatable transfer cube, as recited in the aforementioned U.S. patent application, Ser. No. 451,919 filed Dec. 21, 1982 and hereby incorporated herein by reference, which cube has four planar faces which are parallel to its axis of rotation. Each face has a pair of articulated grippers which replace the partitions and holding bracket of the aforementioned patent application. A biased plate having a foam pad therein is held against each planar face, closer to the axis of rotation of the transfer cube than the grippers, which are disposed one on each edge of the biased plate, parallel to the axis of rotation. The biased plates are movable toward and away from their respective planar faces, by biased camming means, articulated through each face, as described in the aforementioned incorporated patent application.

The articulated grippers each comprise a lever arm journalled on a pintle on two sides of the biased plate. Each lever arm has a flanged shoulder portion on its outwardmost end, which extends over its respective side of the biased plate. The inner end of each lever arm, that end pointing generally towards the center of the deposition machine, has a pin extending from the "plate" side thereof, on which a roller wheel is journalled.

The roller wheel contacts and rolls on a tip portion which extends off of each rear corner of the biased plate as the biased plate moves inwardly and outwardly from its respective face of the transfer cube.

The flanged shoulder portion on the outer end of the lever arm is in pivotable contact with the end of the arm to permit articulation of the flanged shoulder with respect to the biased plate as the biased plate is moved toward and away from its cube face. The lever arm has a spring arrangement to bias the roller wheel portion thereof downwardly against the tab extending off the rearwardmost corners of the biased plate.

An adjustable alignment or gaging mechanism is disposed on the frame of the deposition machine, above and adjacent the cube, between a pair of articulated grippers. The gaging mechanism comprises a pressurizable cylinder having a downwardly extending piston rod. An arcuately shaped plate is attached to the lower end of the piston rod. A slot is cut diagonally across each end of the plate, a pin being adjustably disposed through each slot in the plate. The pins are arranged so as to just contact the upper surface of the foam pad on the biased plate when the biased plate is in its lowermost (receiving) position. The pneumatic cylinder is empowered to properly retract the piston rod so to withdraw the alignment pins from the way of the biased plate once the biased plate is raised to its outermost position, (clamping an item to be reinforced between it and the shoulder portions of the articulated levers), and when the transfer cube is rotated to present a successive surface for unloading of a reinforced article therefrom, and the subsequent loading of an unreinforced article thereon. The gaging mechanism itself is adjustably moveable towards and away from the frame of the machine, by a threaded shaft rotatably arranged therebetween. The gaging mechanism is also adjustably moveable from side to side with respect to the frame of the machine and the axis of rotation of the transfer cube by rotatably adjusting a pair of threaded shafts arranged through stanchions on the frame of the machine on each side of the support arrangement for the gaging mechanism.

Thus an article or substrate such as a lined or unlined shoe upper to be reinforced is placed by a machine operator onto the top surface of the uppermost biased plate on the cube. The article is arranged thereon, so as to come into alignment contact with the pre-set alignment pins disposed in the arcuate plate secured to the lower end of the piston rod on the gaging mechanism. When the article to be reinforced is properly oriented, the machine operator actuates the proper circuitry to raise the biased plate, as recited in aforementioned U.S. patent application. As the biased plate is being raised with the article to be treated thereon, the plate is also lifting the rollers on the inwardmost end of its gripping levers. This causes the outwardmost ends, (those closest to the operator), as well as the flanged shoulder portions thereon, to pivot downwardly to meet and come into pressing contact with the substrate placed on the upwardly advanced biased plate, the substrate or article to be treated being thereby gripped thereto. Subsequent rotation of the transfer cube and simultaneous retractive displacement of the adjustment mechanism advances the substrate/article towards the rotatable belt with the fused powder thereon, and advances an already treated substrate or article of manufacture to its uppermost location, where the biased plate is withdrawn towards its respective face on the transfer cube, releasing the spring biased inner ends of the levers, to lift the flanged shoulders thereby pivoting the grippers away from the surface of the biased plate, permitting the treated article of manufacture to be removed therefrom, and the loading of a subsequent article aligned and gripped thereby for successive working.

By adjusting the gaging mechanism from side to side and then to and from the frame of the machine, the guide pins in the slots may be adjustable over a wider range, to permit the machine operator to consistently align a wide variety of substrate contours. By providing graduations alongside the slots and alongside the frame of the machine and its adjustment mechanisms, concise, repetitive alignment may be secured for various subsequent peripheral contours being worked.

BRIEF DESCRIPTION OF THE DRAWINGS

The object and advantages of the present invention will become more apparent when viewed in conjunction with the following drawings, in which.

DESCRIPTION OF THE PREFERRED EMBODIMENT

Figure 1:
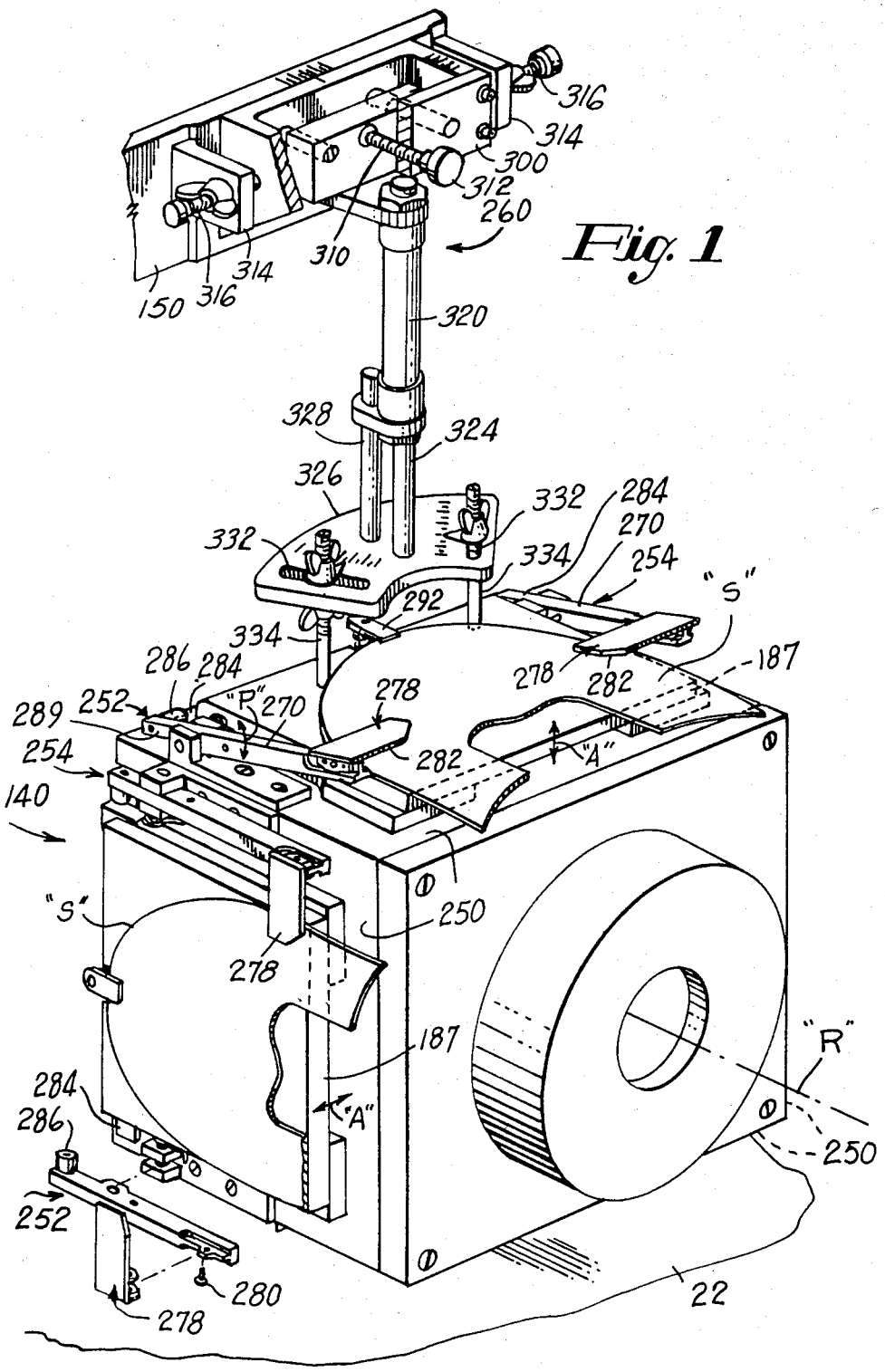
FIG. 1 is a perspective view of a substrate loaded onto a gripper arrangement on the uppermost face of a rotatable transfer cube, with an adjustable gaging mechanism disposed therewith.

Referring now to the drawings in detail, and particularly to FIG. 1, there is shown a transfer means on a powder deposition machine as shown in U.S. patent application Ser. No. 451,919, incorporated herein by reference, the transfer means comprising a rotatable transfer cube 140 having four planar faces 250 parallel to the axis of rotation "R" of the cube 140. Each face 250 has a pair of articulated grippers 252 and 254 disposed on opposite sides of a biased plate 187, as shown in FIG. 1.

Located above the transfer means, is an articulatable alignment or guide means 260, attached to the front side of a upwardly and downwardly movable horizontal beam 150, more fully described, below.

Each biased plate 187 is caused by linkage means, shown in the aforementioned application, to be moved toward and away from their respective planar faces 250, as shown by the arrow "A". A hold-down means was described in that aforementioned application, which was stationary and unsatisfactory for a wide variety of substrates being reinforced.

Figure 2:
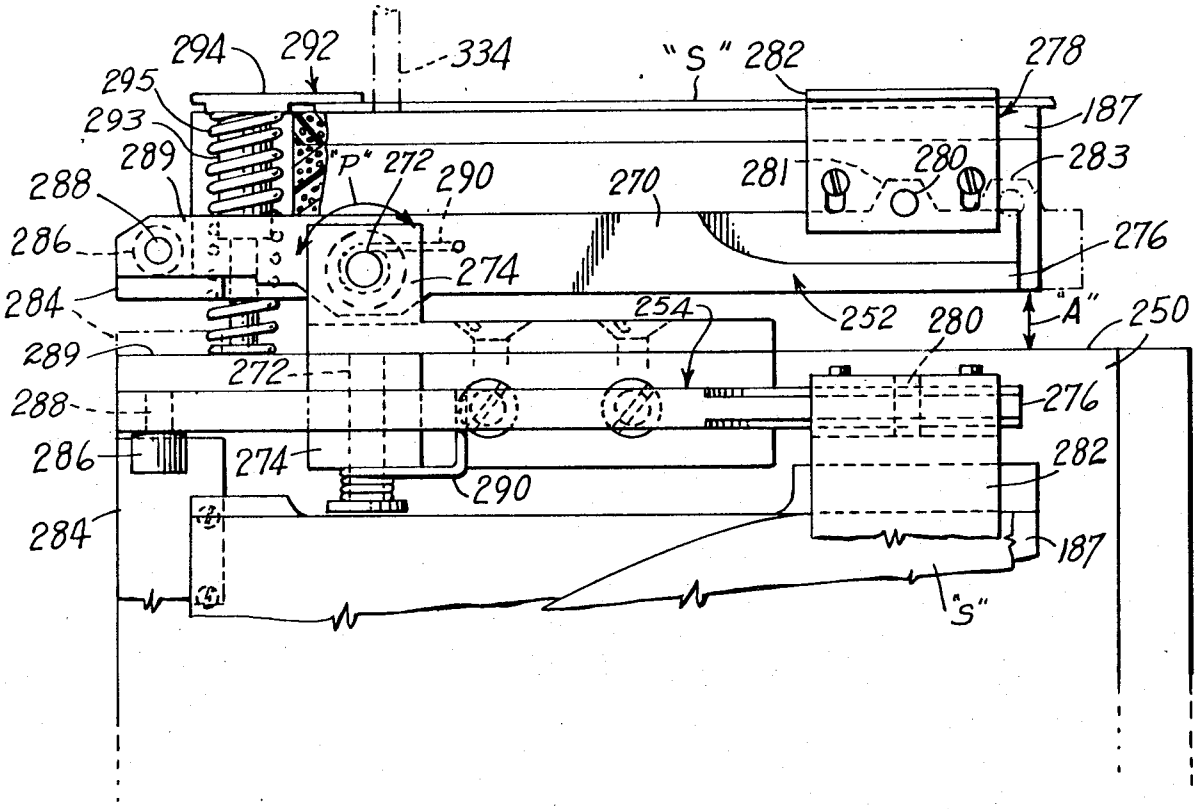
FIG. 2 is a side elevational view of a substrate held by the gripper mechanism in its gripping position.

Each articulated gripper means 252 and 254, comprises a lever arm 270 which is pivotable about a pin 272 as shown by the arrow "P" and journalled in a pintle 274, each pintle 274 being secured to its respective planar face 250, as shown in FIGS. 1 and 2. The lever arm 270 has an outwardly directed end 276 which has an articulated shoulder flange 278 thereon. The flange 278 is freely pivotable on the outer end 276 of the lever arm 276 on a pin 280 journalled therebetween. The flange 278 includes a flat portion 282 which is contactable with the outer surface of a substrate "S" placed on the biased plate 187.

Each biased plate 187 has a tab 284 extending off each inwardmost corner, as shown in FIGS. 1 and 2, which tab 284 is parallel to its biased plate 187. Each lever arm 270 has an inwardly directed end 289 which has a rollable wheel 286 journalled on an axis 288 disposed on the "plate" side of the inner end 289 of the lever arm 270, as shown in the drawings. Each wheel 286, rotatably disposed on the "plate" side of the inner end 289 of each lever arm 270, is in rolling contact with the "upper" surface of its respective tab 284. A torsion spring 290 is disposed about the pin 272 on which the lever arm 270 is journalled. One end of the spring 290 is engaged with the lever arm 270 and the other end is engaged with the pintle 274, so as to provide a biasing means, counterclockwise as seen in FIG. 2, to keep the wheel 286 pressed against the upper surface of the tabs 284 on each biased plate 187, which in FIG. 2, is shown raised away from its respective planar face 250.

A toe guide 292 is arranged along the inner edge of each planar face 250, as shown in FIG. 1. The toe guide 292 comprises an "L" shaped member 294 which is inverted and disposed on a stud 293 attached to the planar face 250. A spring, 295 is arranged about the stud to bias the "L"-shaped member 294 away from its respective planar fact 250. A mark may be arranged on the outer surface of the member 294 to show the machine operator the position from which material is deposited on a substrate, may be measured. The material deposition operation is described in the aforementioned patent application.

A substrate "S" to be reinforced or stiffened, as recited in the aforementioned application, is held securely to the outer surface of the biased plate 187 by the articulated gripper means 252 and 254, as the machine operator has placed the substrates, such as a shoe upper, a visor, an article of clothing or the like, on the biased plate 187, as it is in its retracted most position closest to its respective planar face 250 as shown in FIG. 1. The machine operator then actuates the proper mechanism, shown in the aforementioned application, to move the biased plate 187 away from its planar face 250. In so moving, the biased plate 187 also moves the tabs 284 which are attached thereto. As the tabs 284 are lifted, the inner end 289 of the lever arm 270 is caused to be raised, due to the rolling contact of the wheel 286 attached thereon. The outer end 276 of the lever arm 270 is thus caused to pivot about its pivot pin 272, bringing the flange 278 toward and against the biased plate 187, thus securing any substrate "S" between the flat portion 282 of the flange 278 and the outer surface of the biased plate 187, which is limited in its outwardly directed movement from its planar face.

Figure 3:
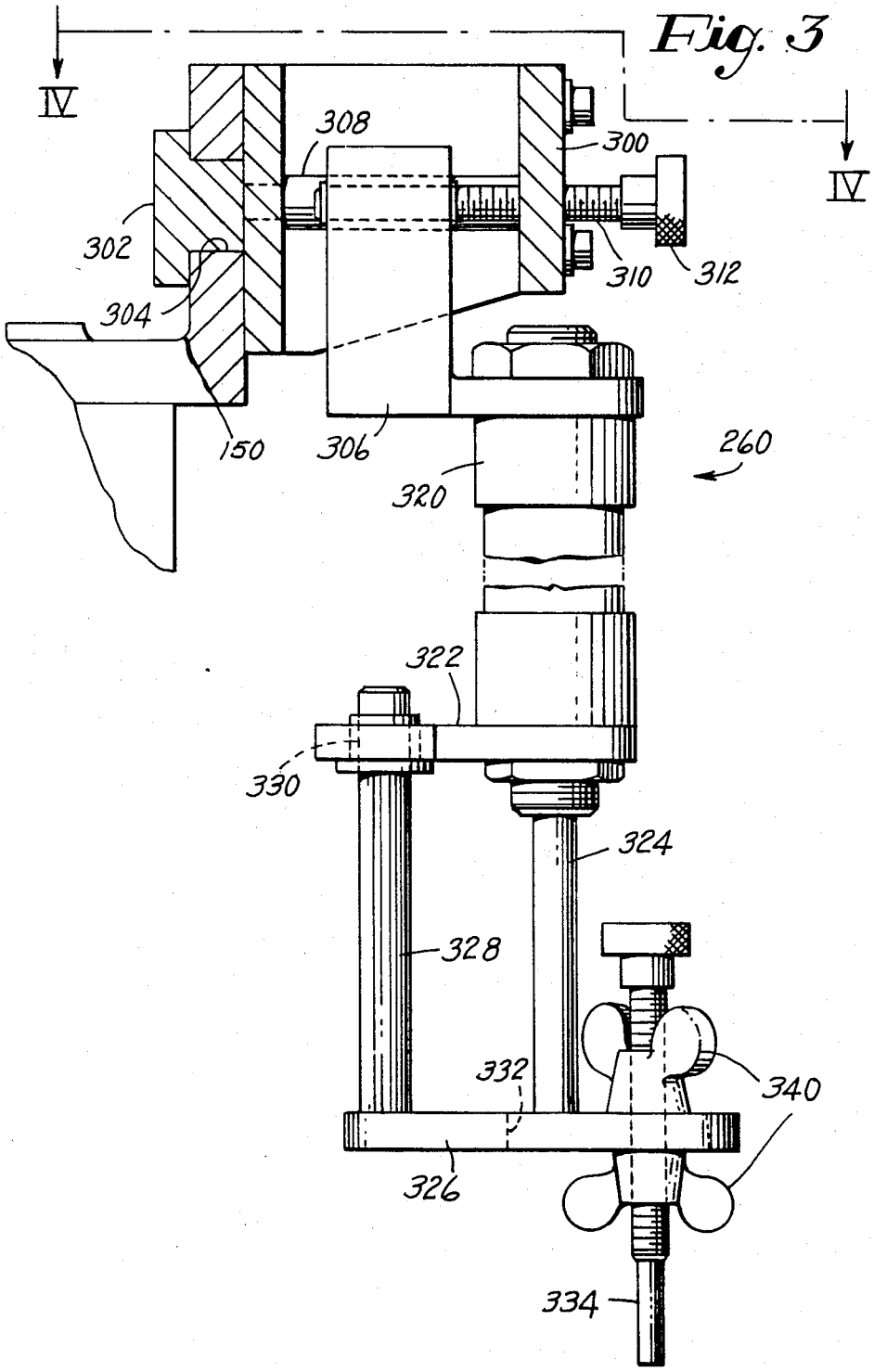
FIG. 3 is a side elevational view of the alignment mechanism.
Figure 4:
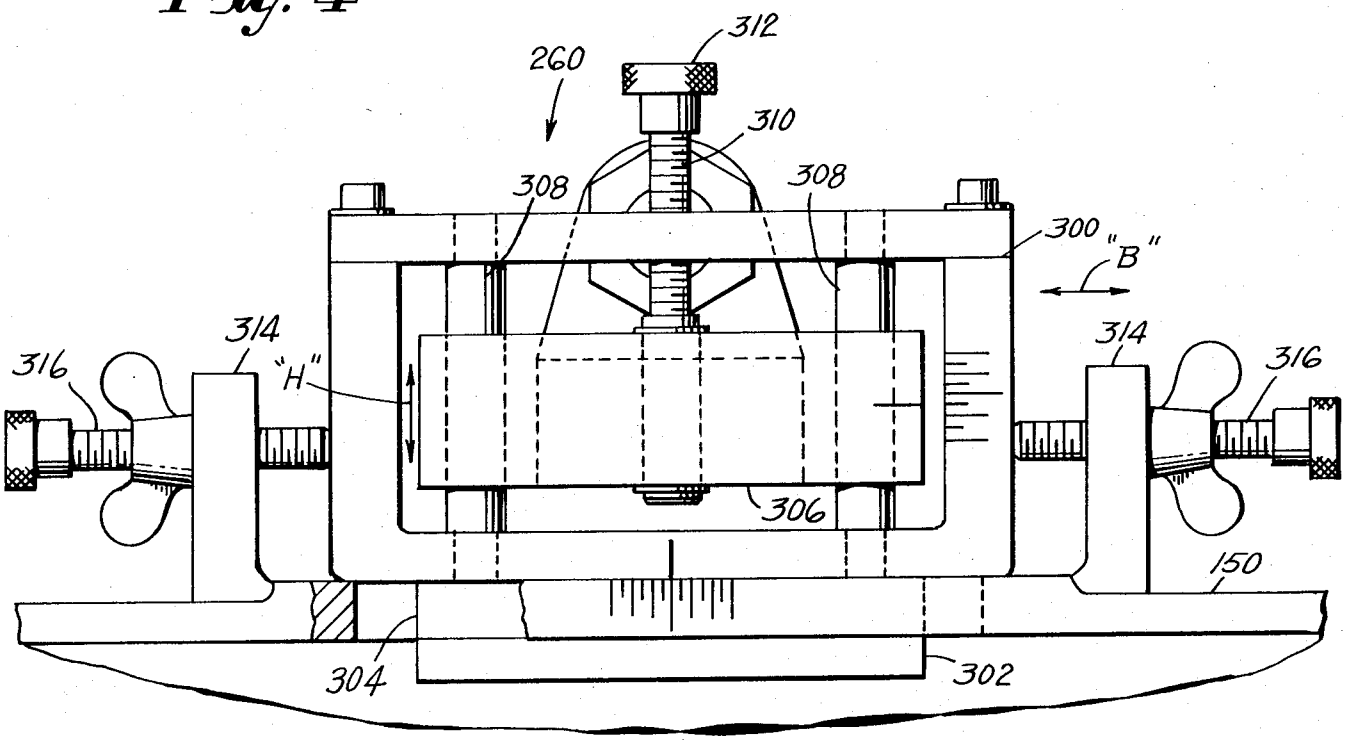
FIG. 4 is a view taken along the lines IV—IV of FIG. 3.

The articulatable guide means 260, is arranged on the front side of the horizontal beam 150, which is a portion of the deposition machine, the beam 150 being shown in FIGS. 1, 3 and 4, is reciprocably movable upwardly and downwardly by properly actuatable means, described in the aforementioned patent application. The guide means 260 comprises a housing 300 which is secured to the beam 150 by a "T"-shaped connector 302 which is slidably disposed in a slot 304 in the beam 150, the connector 302 being attached by its base, to the housing 300, as shown in FIGS. 3 and 4. The housing 300 encloses an "L"-shaped block 306 which is slidable forwardly and rearwardly as shown by an arrow "H" in FIG. 4, on a pair of rods 308 within the housing 300. A threaded shaft 310 is rotatively secured to the "L"-shaped block 306 between the two rods 308. The threaded shaft 310 is threadably received through the front portion of the housing 300, having a control knob 312 on the distal end thereof, as shown in FIGS. 1, 3 and 4. A pair of stanchions 314 are attached to the horizontal bar 150 spaced from each side of the housing 300, as shown in FIG. 4. An adjustable bolt 316 is threaded through each stanchion 314 into abutting contact with a side wall of the housing 300, to facilitate side to side adjustment of the housing 300, as shown by the arrow B in FIG. 4.

The upper portion of the double acting pressurizable cylinder 320 is attached to the lower portion of the "L"-shaped block 306, the lower portion of the cylinder 320 having a bracket 322 secured thereto. A piston-rod 324 extends downwardly from the cylinder 320, the lower end of the rod 324 being attached to an arcuately shaped support plate 326. The support plate 326 has an upstanding rod 328 at the rear side of its mid-section, which rod 328 is in slidable engagement with an opening 330 in the bracket 322. A pair of slots, 332 are obliquely arranged, one at each end of the support plate 326, at about 45° with respect to the axis of rotation "R" of the rotatable transfer cube 140, as may be seen in FIG. 1. A guide pin 334 is disposed in each slot 332, so as to be movable therein and securable at a particular location in their slot 332, by locking means such as wing nuts 340 or the like, as shown in FIGS. 1 and 3. The lower ends of the guide pins 334 are in abuttable contact with the upper surface of the uppermost biased plate 187 on the transfer cube 140.

Alternatively, the support plate 326 may be arranged to "snap" onto the rod 324, by any known making arrangement therebetween, the pins 334 being fixed in definite holes instead of elongated slots 332, each snap on support plate with the fixed pins being available for a particular configured substrate to be worked.

The guide pins 334 act as backstops for the substrate "S", such as a shoe upper, when it is placed on the transfer cube 140 for subsequent coating with a substance as described in the aforementioned application.

In operation of the guide means 260 and the grippers 252 and 254 on the machine, the "L"-shaped block 306 may be set in its proper forward-backward location by adjustment of the control knob 312 on the end of the threaded shaft 310, rotation of which brings the block 306 and hence the cylinder 320 and guide pins 334 forwardly or rearwardly, depending on the direction of rotation of the knob 312. The adjustable bolts 316 in the stanchions 314 may be turned accordingly, to move the housing 300, together with the "L"-shaped block 306 and hence the guide pins 334 to the left or to the right with respect to the transfer cube 140 and its axis of rotation "R". The machine operator may thereby preset the location of the guide pins 334 at their proper location in their respective slots 332, their positions not necessarily matching one another—depending upon the substrate configuration being loaded into the machine or "snap" in a preconfigured support plate with its fixed pins onto the rod 324 for the particular substrate being worked. The operator then tightens the tightening means 340 to lock the pins 334 in place. The slots 332 as well the beam 150 and stanchions 314 may have marks along their periphery, as shown in FIGS. 1 and 4, to enable the operator to duplicate settings of the guide pins 334 therein at a subsequent time.

Thus, when the guide pins 334 are properly located, onto the biased plate 187 which is in its lowermost position closest to its planar face 250, the grippers 252 and 254 are poised at an angle, with their flanges 278 lifted away from the biased plate 187.

The operator then loads a substrate "S" onto the biased plate 187, aligning its perimeter with the points defined by the pre-adjusted guide pins 334 and the toe guide 292. By actuation of proper means, the biased plate 187 may be raised away from the surface of its respective planar face 250. The tabs 284 are thus similarly raised so as to roll the wheels 286 on the inner end 289 of each lever arm 270 of the grippers 252 and 254. The substrate "S" is thus held securely to the outer surface of the biased plate 187 by the downwardly directed force of the pivotable flange 278 on the ends of the lever arms 270.

As the transfer cube 140 is caused to rotate about its axis "R" by proper means described in the aforementioned patent application, a subsequent biased plate 187 is presented facing upwardly, to the operator, ready for off-loading of a coated substrate, and for loading of a substrate "S" to be treated. Coincident with the rotation of the transfer cube 140, is actuation, by proper pressurizable means not shown, of the pressurizable cylinder 320, sufficient to withdraw the piston-rod 324 therein, to effectuate lifting the support plate 326 and the guide pins 334 thereattached, to provide clearance for the edges of the transfer cube 140, as it rotates. The pressurizable cylinder 320 is properly actuated to return the guide pins 334 to their lowermost position upon the cessation of rotation of the transfer cube 140, to permit subsequent substrates "S" to be loaded thereon in a consistently accurate manner.

Thus there has been shown an arrangement of unique mechanisms to permit a substrate such as a shoe upper or the like to be properly and consistently aligned onto a transfer mechanism and securely held thereon, and being capable of subsequent adjustment for various peripheral configurations.

We claim:

1. A method of loading a flexible substrate on a movable base on a rotatable transport mechanism of a powder deposition machine, comprising the steps of:

adjusting a guide pin support arrangement with respect to its distance from the frame of the machine by threadable articulation of a member therebetween;

adjusting said guide pin support arrangement side to side with respect to the axis of rotation of the rotatable transport mechanism by threadable articulation at least one member between said frame and said support arrangement;

locating an arrangement of guide pins on said guide pin support arrangement to provide proper alignment for a substrate to be guided thereby; and pivoting a gripper mechanism off each side of the movable base so to provide space to insert a substrate up to the pre-arranged guide pins and onto the base which grippers prevent dislodging of said substrate during subsequent base rotation.

2. A method of loading a flexible substrate on a movable base on a rotatable transport mechanism of a powder deposition machine, as recited in claim 1, including:

moving said guide pins in an arrangement of slots in a bracket on said guide pin support to define a particular substrate configuration.

3. A method of loading a flexible substrate, on a movable base on a rotatable transport mechanism of a powder deposition machine, as recited in claim 1, also including the steps of:

rolling a wheel disposed on one end of said gripper mechanism against a tab extending from said movable base so as to cause the pivoting of said gripper mechanism to occur.

4. A method of loading a flexible substrate on a movable base on a rotatable transport mechanism of a powder deposition machine as recited in claim 3, also including the steps of:

pivoting a flange member on the other end of said gripper mechanism from said wheel, so as to permit parallelism to occur between said flange and the movable base so as to not damage any substrate loaded therebetween.

5. A method of loading a flexible substrate, on a movable base on a rotatable transport mechanism of a power deposition machine as recited in claim 3, also including the steps of:

retracting the arrangement of guide pins when the rotatable transport mechanism is rotated.

6. A method of loading a flexible substrate on a movable base on a rotatable transport mechanism of a powder deposition machine as recited in claim 5, also including the steps of:

pressuring said guide pins support arrangement upon actuation of rotation of the rotatable transport mechanism to permit said retraction of said guide pin arrangement.

7. A method of loading a flexible substrate on a movable base on a rotatable transport mechanism of a powder deposition machine as recited in claim 4, also including the steps of:

biasing said gripper mechanism against pivoting, by a spring arranged between a support for said gripper mechanism and said gripper mechanism.

* * * * *